US006823592B1

(12) United States Patent
Rowe

(10) Patent No.: US 6,823,592 B1
(45) Date of Patent: Nov. 30, 2004

(54) CUTTER FOR HAMMER TACKER

(76) Inventor: Ronald Rowe, 3218 Shamrock Ave., Merced, CA (US) 95340

( * ) Notice: Subject to any disclaimer, the term of this patent is extended or adjusted under 35 U.S.C. 154(b) by 12 days.

(21) Appl. No.: 10/114,885

(22) Filed: Apr. 2, 2002

(51) Int. Cl.[7] ..... B26B 11/00; B25D 1/00
(52) U.S. Cl. ..... 30/329; 30/1; 7/144; 7/160
(58) Field of Search ..... 30/329, 1; 7/160, 7/144; 227/79, 156

(56) References Cited

U.S. PATENT DOCUMENTS 731,916 A * 6/1903 Koegel ..... 7/144
1,572,898 A * 2/1926 Martin ..... 7/144
2,631,372 A * 3/1953 Fournier ..... 20/329 X
2,833,032 A * 5/1958 Aciego ..... 30/1
3,233,643 A * 2/1966 Reuterfors ..... 7/144 X
4,936,014 A * 6/1990 Shaanan et al. ..... 30/329 X
5,911,761 A * 6/1999 Tilley ..... 7/160
6,047,427 A * 4/2000 Whitlock, Jr. et al. ..... 7/144
6,286,745 B1 * 9/2001 Ackeret ..... 227/156 X
6,339,858 B1 * 1/2002 Fraga et al. ..... 7/144
6,418,624 B1 * 7/2002 Huang ..... 30/162
6,484,404 B1 * 11/2002 Kao ..... 30/162
6,493,893 B1 * 12/2002 Ackeret ..... 7/160
6,510,612 B1 * 1/2003 Cybulski ..... 30/162
6,574,872 B2 * 6/2003 Roberts et al. ..... 30/329 X

* cited by examiner

*Primary Examiner*—Charles Goodman
(74) *Attorney, Agent, or Firm*—Jack Lo

(57) ABSTRACT

The present cutter is comprised of a plate for attaching to the top of a conventional hammer tacker. A notch at the front end of the plate is for engaging a raised head at the front of the hammer tacker. A belt clip projecting from the rear end of the plate is angled away from the hammer tacker for clipping to a belt. A side extension is arranged on the plate to one side of the notch. A shallow groove is arranged on the bottom surface of the side extension, and a blade is positioned in the groove. A thumb screw attached to the blade is positioned through a slot in the side extension. The blade is movable along the groove for extension or retraction relative to the front end of the plate. When extended, the blade is angled to one side of the hammer tacker.

4 Claims, 1 Drawing Sheet

CUTTER FOR HAMMER TACKER

BACKGROUND OF THE INVENTION

1. Field of the Invention

This invention relates generally to hammer tackers.

2. Prior Art

A hammer tacker is an industrial stapler in the shape of an elongated bar, somewhat like a hammer without the head. It is operated with a hammering action which is much less tiring than the squeezing action required by lever-operated staplers. It is typically used in the construction industry, such as for tacking roofing paper to roofs. Because of the bar shape, hammer tackers tend to roll off roofs easily. When they do, the workers must climb down from the roofs to retrieve them.

Roofing paper must be trimmed to size after it is tacked. Conventional utility knives are usually used for cutting the paper. Such knives are inconvenient because the roofers must constantly switch between the hammer tackers and the knives. When repeated many times a day, day after day, the switching becomes annoying and productivity is reduced.

OBJECTIVES OF THE INVENTION

Accordingly, the objectives of the present cutter for hammer tacker are:

to attach a blade to a hammer tacker so as to enable a worker to tack and cut sheet materials with a single tool;
to not interfere with the operation of the tacker;
to provide a retractable blade for safety;
to be attachable to a belt; and
to prevent the hammer tacker from rolling off roofs.

Further objectives of the present invention will become apparent from a consideration of the drawings and ensuing description.

BRIEF SUMMARY OF THE INVENTION

The present cutter is comprised of a plate for attaching to the top of a conventional hammer tacker. A notch at the front end of the plate is for engaging a raised head at the front of the hammer tacker. A belt clip projecting from the rear end of the plate is angled away from the hammer tacker for clipping to a belt. A side extension is arranged on the plate to one side of the notch. A shallow groove is arranged on the bottom surface of the side extension, and a blade is positioned in the groove. A thumb screw attached to the blade is positioned through a slot in the side extension. The blade is movable along the groove for extension or retraction relative to the front end of the plate. When extended, the blade is angled to one side of the hammer tacker.

Figure 1:
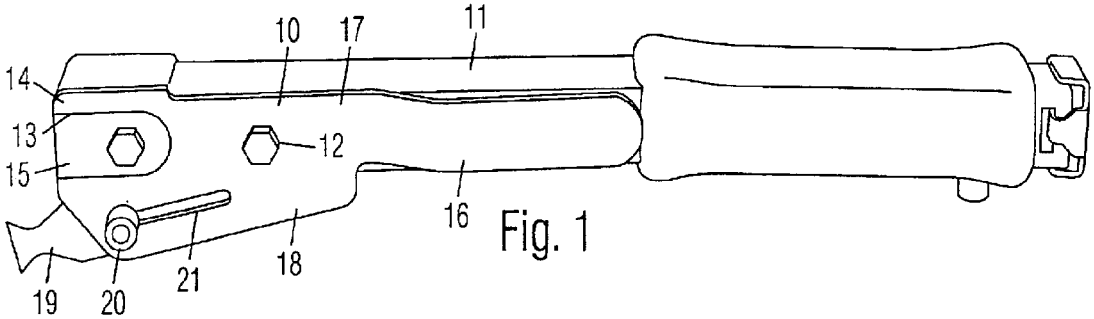
FIG. 1 is a top view of the present cutter attached to the top of a conventional hammer tacker.

| DRAWING REFERENCE NUMERALS |
|---|
| 10. Plate |
| 11. Hammer Tacker |
| 12. Fastener |
| 13. Notch |
| 14. Forked Front End |
| 15. Raised Head |
| 16. Belt Clip |
| 17. Rear End |
| 18. Side Extension |
| 19. Blade |
| 20. Thumb Screw |
| 21. Slot |
| 22. Tack Ejection Port |
| 23. Groove |
| 24. Hole |

DETAILED DESCRIPTION OF THE INVENTION

FIG. 1:

A preferred embodiment of the present cutter is shown in a top view in FIG. 1. It is comprised of a plate 10 adapted to be attached to the top surface of a conventional hammer tacker 11 with a fastener 12 such as a screw or bolt. A notch 13 at a forked front end 14 of plate 10 is for engaging a raised head 15 at the front of hammer tacker 11. Raised head 15 is common to many hammer tackers currently in use, so that the cutter may be easily retrofitted to them. Plate 10 is thus secured at fastener 12 and notch 13. A belt clip 16 projecting from a rear end 17 of plate 10 is angled upwardly from a top surface of plate 10, and is thus adapted to be angled away from the top surface of hammer tacker 11 for clipping to a belt A side extension 18 is arranged on plate 10 to one side of notch 13 and is generally coplanar with plate 10.

A conventional roofer's blade 19 is positioned on the bottom surface of plate 10. Alternatively, any other type of blade may be attached if desired. A thumb screw 20 is attached to blade 19 through a slot 21 in side extension 18. Blade 19 is movable for extension or retraction relative to front end 14 of plate 10. The shape of the present cutter is conducive for being stamped out of a flat sheet of metal, so that it is inexpensive to produce.

When extended as shown, blade 19 is adapted to project forward and sideward from the front of hammer tacker 11. Hammer tacker 11 is positioned on its left side in FIG. 1 to position blade 19 for cutting. As an added benefit, hammer tacker 11 is prevented from rolling off roofs by side extension 18 and belt clip 16.

Figure 2:
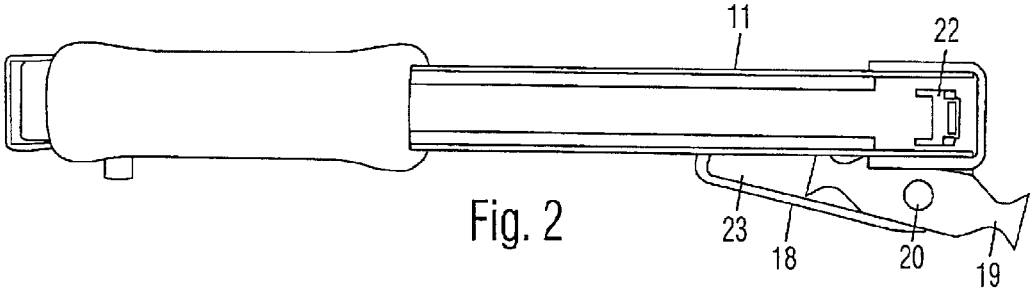
FIG. 2 is a bottom view thereof.

FIG. 2:

The cutter is shown attached to hammer tacker 11 in a bottom view in FIG. 2. Tacks are ejected from an ejection port 22 at the bottom front of hammer tacker 11. An elongated shallow groove 23 is arranged on the bottom surface of side extension 18 at an acute angle, such as 10 degrees, relative to the common longitudinal directions of plate 10 (FIG. 1) and hammer tacker 11. Groove 23 may be a depression, or it may be simply defined by a pair of parallel ribs. Blade 19 is movably positioned within groove 23, which is parallel to slot 20 (FIG. 1).

Figure 3:
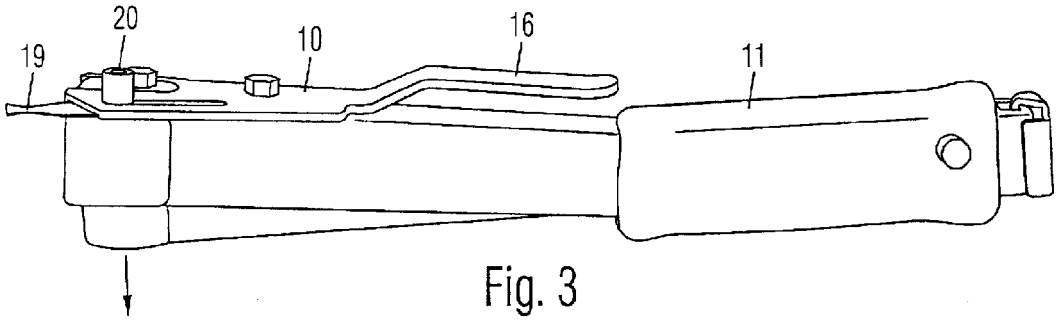
FIG. 3 is a side view thereof.

FIG. 3:

The cutter is shown attached to hammer tacker 11 in a side view in FIG. 3. Since the cutter is attached to the top surface of hammer tacker 11 and arranged to project to its side, it does not interfere with tacking operation. The direction of tack ejection from hammer tacker 11 is indicated by the arrow. Tacking may be performed by holding hammer tacker 11 with the port toward the work piece, and cutting may be done by simply rotating hammer tacker 11 to its side to position the blade on the work piece, as in FIG. 1.

Figure 4:
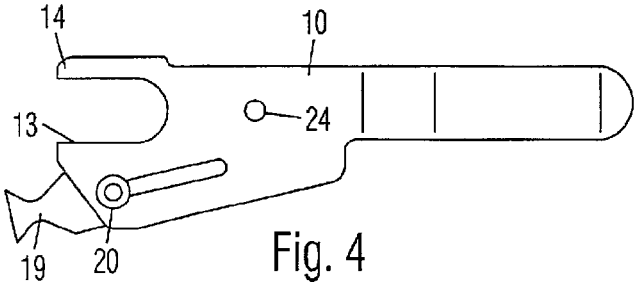
FIG. 4 is a top view of the cutter alone.
Figure 5:
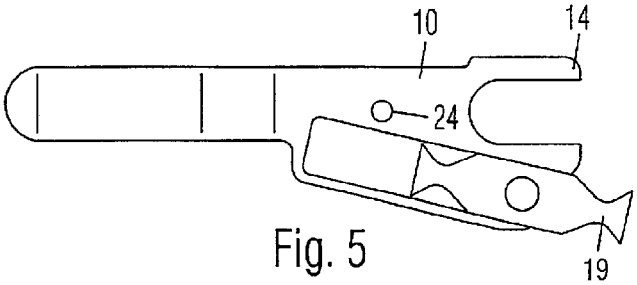
FIG. 5 is a bottom view of the cutter alone.

FIGS. 4–5:

The cutter is shove alone without the hammer tacker in a top view in FIG. 4, and a bottom view in FIG. 5. A hole 24 is arranged on plate 10 for receiving the bolt. Blade 19 is fully retractable within front end 14 of plate 10 for safety by operating thumb screw 20.

SUMMARY AND SCOPE

Accordingly, the present cutter attaches a blade to a hammer tacker so as to enable a worker to tack and cut sheet materials with a single tool. It does not interfere with the operation of the tacker. It provides a retractable blade for safety. It is attachable to a belt. It also prevents the hammer tacker from rolling off roofs.

Although the above description is specific, it should not be considered as a limitation on the scope of the invention, but only as an example of the preferred embodiment. Many variations are possible within the teachings of the invention. For example, the cutter may be provided as an integral part of the hammer tacker. Therefore, the scope of the invention should be determined by the appended claims and their legal equivalents, not by the examples given.

What is claimed is:

1. A cutter for a hammer tacker, comprising:

an elongated plate for attaching to an elongated top surface of said hammer tacker;

a fastener on said plate for attaching to said top surface of said hammer tacker;

a forked front end on said plate defining a notch for engaging a raised head at a front of said hammer tacker, wherein said forked front end and said fastener cooperate to align sad plate with said hammer tacker;

a side extension extending from a side of said plate to avoid interfering with tacking operation;

a blade movably positioned on said side extension and movable between an extended position projecting from a front end of said side extension, and a retracted position under said side extension.

2. The cutter of claim 1, further including a belt clip projecting from a rear end of said plate and angled upwardly from a top surface of said plate, said belt clip being arranged for angling away from said top surface of said hammer tacker for clipping to a belt.

3. A hammer tacker apparatus, comprising:

a hammer tacker;

an elongated plate attached to an elongated top surface of said hammer tacker;

a fastener on said plate secured to said top surface of said hammer tacker;

a forked front end on said plate defining a notch engaging a raised head at a front of said hammer tacker, wherein said forked front end and said fastener cooperate to align sad plate with said hammer tacker;

a side extension extending from a side of said plate to avoid interfering with tacking operation;

a blade movably positioned on said side extension and, movable between an extended position projecting from a front end of said side extension, and a retracted position hidden under said side extension.

4. The cutter of claim 3, further including a belt dip projecting from a rear end of said plate and angled upwardly from a top surface of said plate, said belt clip being arranged for angling away from said top surface of said hammer tacker for clipping to a belt.

* * * * *